US008585563B2

(12) United States Patent
Wilson

(10) Patent No.: US 8,585,563 B2
(45) Date of Patent: Nov. 19, 2013

(54) MULTI-FUNCTION, VARIABLE-ASSIST PUSHUP SYSTEM

(76) Inventor: Kelce S. Wilson, Murphy, TX (US)

( * ) Notice: Subject to any disclaimer, the term of this patent is extended or adjusted under 35 U.S.C. 154(b) by 453 days.

(21) Appl. No.: 13/083,576

(22) Filed: Apr. 10, 2011

(65) Prior Publication Data

US 2012/0258846 A1 Oct. 11, 2012

(51) Int. Cl.
*A63B 21/06* (2006.01)
*A63B 26/00* (2006.01)

(52) U.S. Cl.
USPC ..... 482/93; 482/106; 482/141

(58) Field of Classification Search
USPC ..... 482/93, 98, 106–108, 141–142; D21/681–682, 683, 684
See application file for complete search history.

(56) References Cited

U.S. PATENT DOCUMENTS

| | | | | |
|---|---|---|---|---|
| 6,436,015 | B1 * | 8/2002 | Frasco et al. | 482/106 |
| 6,592,498 | B1 * | 7/2003 | Trainor | 482/97 |
| 6,702,723 | B2 * | 3/2004 | Landfair | 482/93 |
| 7,396,319 | B1 * | 7/2008 | Ellis | 482/100 |
| 7,758,478 | B2 * | 7/2010 | Golesh et al. | 482/98 |
| 7,766,800 | B1 * | 8/2010 | Krull | 482/93 |
| D688,759 | S * | 8/2013 | Davies, III | D21/680 |
| 2001/0049324 | A1 * | 12/2001 | Wallace et al. | 482/106 |
| 2002/0091044 | A1 * | 7/2002 | Lien et al. | 482/106 |
| 2003/0083179 | A1 * | 5/2003 | Landfair | 482/93 |
| 2004/0069726 | A1 * | 4/2004 | Marchetta et al. | 211/36 |
| 2006/0211549 | A1 * | 9/2006 | Nohejl | 482/97 |
| 2012/0094810 | A1 * | 4/2012 | Anderson | 482/107 |

* cited by examiner

*Primary Examiner* — Stephen Crow
(74) *Attorney, Agent, or Firm* — Kelce S. Wilson

(57) ABSTRACT

A system is described that simultaneously (1) provides for at least 10 different height adjustments for assisted pushups; (2) provides an adjustable ankle-holding situp bar to accommodate differently-sized feet; (3) can compensate for an uneven exercise surface; (4) requires no permanent mounting or any installation; (5) does not require use of a doorway; (6) is highly compact for storage; (7) can be disassembled for storage using a trivial procedure that is already well-known by most gym users; (8) leverages existing, widely-used and inexpensive home gym equipment to provide some portions of the system, thereby reducing expense; and (9) can be used as a weight for some barbell exercises, thereby stretching the home gym user's money; and (10) can be used as a weight plate on a weight bar for weightlifting exercises, thereby further stretching the home gym user's money. Alternative systems are also described.

15 Claims, 5 Drawing Sheets

MULTI-FUNCTION, VARIABLE-ASSIST PUSHUP SYSTEM

TECHNICAL FIELD

The present invention relates to exercise equipment, including free weights and pushup systems.

BACKGROUND

The currently-available home gym equipment for two types of exercises, (1) assisted pushups and (2) situps, have notable deficiencies. These problems are compounded by the limited budgets and strict space constraints that are faced by many consumers who wish to use home-based exercise equipment.

Pushups are common exercises for improving their upper body strength. One recommendation for improving pushup performance is to do pushups with multiple levels of exertion. This can be accomplished by performing pushups at varying angles, from nearly horizontal, for example with hands and toes on a level floor, up to some higher angle, for example with hands at an elevated position relative to toes. A pushup performed with hands at an elevated position is often called an assisted pushup, because the elevated starting position of the hands makes a pushup easier to perform.

Many outdoor par courses, which are running trails that have strength and flexibility exercise stations at a series of sites along the trail, will have a pushup station with typically 3 pushup bars at differing heights. The user can grasp one of the bars, to keep their hands out of the dirt, and attempt to perform a recommended number of pushups. As users gain upper body strength, they may progressively move from the highest bar, which provides the greatest assistance, to the lowest bar, which provides the least assistance.

Unfortunately, the pushup bars at par courses are public, so they may be crowded; they tend to be outdoors, which limits use during inclement weather; they may not be conveniently located, which limits their availability; and they are too large to fit within the amount of space that is dedicated to most home gyms. Therefore, assisted pushup equipment that overcame all of these limitations, while providing multiple levels of assistance, would be desirable.

A situp is another common exercise, and it also presents challenges. For most people, it is difficult to keep feet on the floor when performing situps, and this can negatively impact the benefit of the exercise. Several solutions exist: a partner who holds the exerciser's ankles; a bench with an ankle-holding bar at one end, under which someone can place their feet; a bar that is held in place in a doorway or under a door itself; and a bar that is attached to a wall.

Unfortunately, someone who lacks a reliable exercise partner, does not have space for a situp bench, cannot find a conveniently-located doorway, and who doesn't want to drill holes in walls of their house, cannot use any of these existing solutions. Therefore, ankle-holding situp equipment that overcame all of these limitations, while accommodating multiple sizes of feet for different users, would be desirable.

There has been a failure of others to provide a solution that solves all of the above-mentioned problems simultaneously, which is also highly compact when stored, can be furnished for a low cost, and yet additionally provides for a third functionality, in order to maximize cost efficiency for home gym users.

BRIEF DESCRIPTION OF THE DRAWINGS

For a more complete understanding of the present invention, reference is now made to the following descriptions taken in conjunction with the accompanying drawings, in which.

DETAILED DESCRIPTION

A system is described that simultaneously (1) provides for at least 10 different height adjustments for assisted pushups; (2) provides an adjustable ankle-holding situp bar to accommodate differently-sized feet; (3) can compensate for an uneven exercise surface; (4) requires no permanent mounting or any installation; (5) does not require use of a doorway; (6) is highly compact for storage; (7) can be disassembled for storage using a trivial procedure that is already well-known by most gym users; (8) leverages existing, widely-used and inexpensive home gym equipment to provide some portions of the system, thereby reducing expense; and (9) can be used as a weight for some barbell exercises, thereby stretching the home gym user's money; and (10) can be used as a weight plate on a weight bar for weightlifting exercises, thereby further stretching the home gym user's money. Alternative systems are also described.

An illustrated embodiment is constructed of only a single piece of material, with no moving parts. Thus, at least one embodiment of the invention may appear, upon initial inspection, to be rather simplistic. However this is a result of the elegance of the design that simultaneously integrates multiple features—rather than a result of triviality. The failure of others to furnish a product for the home gym market, which provides so many simultaneous advantages, is clear evidence of nonobviousness.

Figure 1:
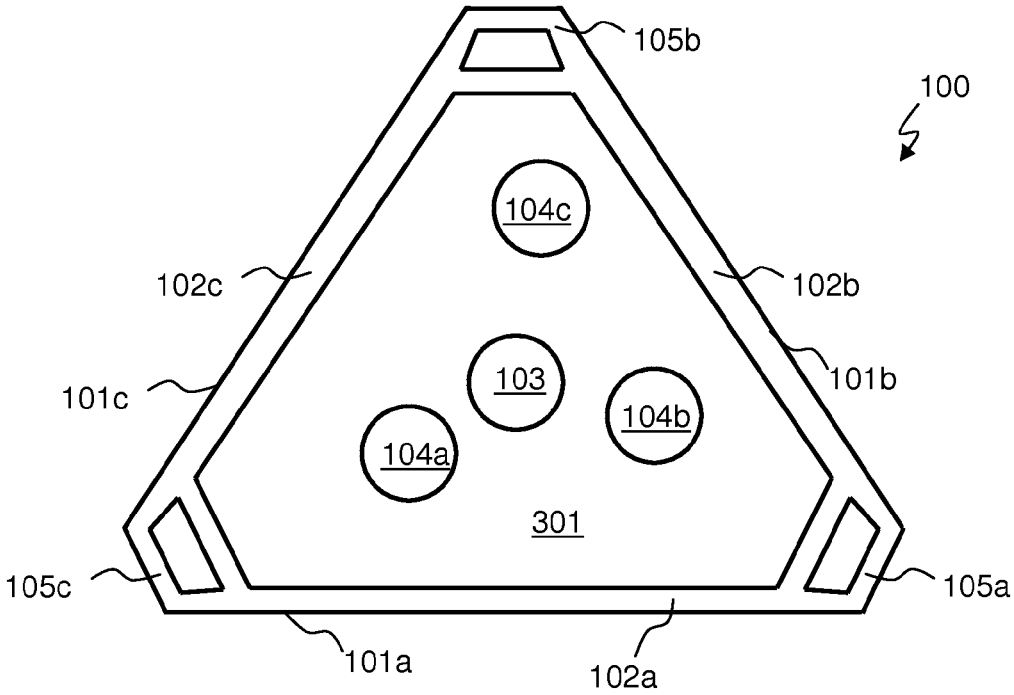
FIG. 1 illustrates an embodiment of a multi-function, variable-assist pushup device.
Figure 2:
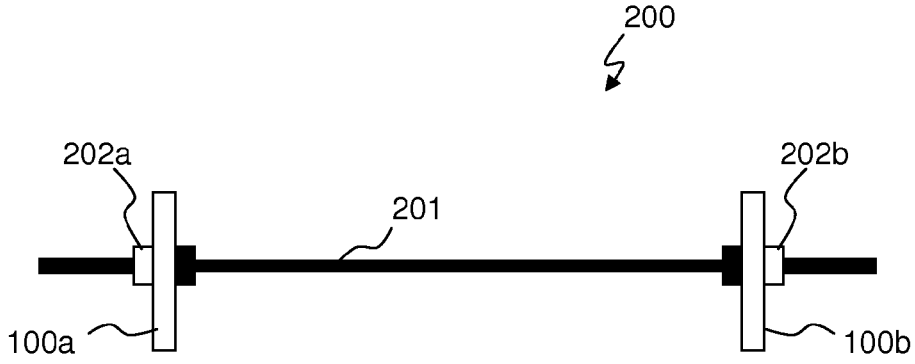
FIG. 2 illustrates an embodiment of a multi-function, variable-assist pushup system.

FIG. 1 illustrates an embodiment of a multi-function, variable-assist pushup plate 100. Plate 100 is a component of a multi-function, variable-assist pushup system 200, which is illustrated in FIG. 2. System 200 comprises two of plates 100, identified as 100*a* and 100*b* and shown in an edge view, along with a weight bar 201 and weight collars 202*a* and 202*b*. Weight bars and weight collars are so ubiquitous that they are already part of many users' home gym equipment. Although a straight bench press weight bar (as illustrated) may be preferred by many users of system 200, because its length provides more space for shoulder room, a curl bar may be preferred by some users in the role of bar 201. The angled grips of a curl might provide a more comfortable wrist position for some users and some styles of pushup exercises. In any case, whether a user wishes to use a bench press bar, a curl bar, or alternate between the two styles for differing pushup positions, the proposed system 200 is cost-efficient. Any expense that the user incurs for purchasing weight bar 201 and weight collars 202*a*-202*b* is shared with a myriad of other common exercises. However, many users already have these components, requiring only the purchase of two of plates 100 in order to assemble a fully-functional version of system 200.

Figure 3:
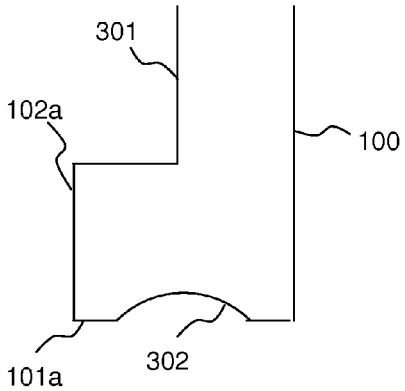
FIG. 3 illustrates a cross-sectional view of a portion of a multi-function, variable-assist pushup device.

Plate 100 comprises three straight edges 101*a*-101*c*, making it approximate an equilateral triangle, although it should be understood that some embodiments may have a different number of straight edges. Squares, pentagrams, octagons, and other shapes are possible. Straight edges 101*a*-101*c* enable plate 100 to be used as a floor stand for a weight bar placed horizontally, parallel with a floor to be used as a pushup bar, as illustrated in FIG. 2—without plate 100 rolling during a pushup exercise. This is because each of straight edges 101*a*-101*c* is flat on the face that contacts the floor. In the illustrated embodiment, edges 101*a*-101*c* have corresponding lips 102*a*-102*c*, which provide a wide contact area between a support surface, such as the floor, and whichever one of edges 101*a*-101*c* is in contact with the floor. As can be seen in FIG. 3, which provides a cut-away view from the side (another edge view), the thickness of plate 100 at a lip, for example 102*a*, is greater the than the thickness of the interior portion 301 of plate 100. Additionally, some embodiments may have a scallop 302, which helps prevent plate 101 from wobbling in a direction perpendicular to a user's body (lateral wobble), when performing a pushup exercise. This is because scallop 302 creates two regions of contact that span a gap, rather than allowing plate 100 to potentially bear weight from the middle of edge 101*a*.

The illustrated embodiment of plate 100 also comprises a center aperture 103, and three offset apertures 104*a*-104*c*. In some embodiments, apertures 103 and 104*a*-104*c* are approximately 52 millimeters (mm) in diameter, to accommodate the weight placement sections of widely-used "Olympic" weight bars. In the US, these weight bars are also called 2" (two-inch) weight bars, to indicate the approximate diameter of the weight shaft. Common Olympic weight bars typically have 50 mm diameter weight shaft sections at each end, over which Olympic weight plates may be placed by a user. Typical Olympic weight plates have circular center apertures of about 51 to 53 mm, based on the manufacturer's design tolerances. Apertures 103 and 104*a*-104*c* should preferably have a diameter at toward the lower range of the acceptable tolerance for placing over a weight bar, in order to minimize lateral wobble of plate 100 during pushups. The locations of apertures 103 and 104*a*-104*c* on plate 100 will be described in more detail in the descriptions of FIGS. 4-7.

Apertures 103 and 104*a*-104*c* may each be surrounded by aperture collars, each collar being a region of increased thickness of plate 100 surrounding a respective one of apertures 103 and 104*a*-104*c*. Such aperture collars provide additional structural strength for plate 100 around potential weak points, due to the voids of material in apertures, as well as additional contact area between a weight plate and a bar's weight shaft in order to reduce wobble of the plate on the bar. Aperture collars are used extensively on Olympic style weight plates, although they tend to be absent in the one-inch style weight plates. In some embodiments, the amount of material in each aperture collars will have approximately the same mass of material that is absent from plate 100, due to voids of material in the apertures. With this arrangement, plate 100 can be constructed to have approximately the same mass and balance as if each of the offset apertures 104*a*-104*c* were absent.

Some embodiments of plate 100 may be constructed from cast iron or steel or another material having a density similar to that of cast iron or steel, so that some embodiments of plate 100 could weigh approximately 25, 35 or 45 pounds (lbs). Metals, such as cast iron and steel, which are commonly used for weight bars and weight plates, have material densities ranging from 6,800 to 8,000 kilograms per cubic meter. This provides a reasonable size to weight ratio for use as exercise equipment weight plates. Lower material densities might not provide a beneficial amount of weight for a manageable size in many home gyms, although there may be some application for lighter-weight plates.

The use of a heavy material enables a home gym user to use some embodiments of plate 100 as free weights for exercises such as bench presses, dead lifts, squats, and two-arm curls, by placing plate 100 onto a weight shaft of a weight bar, using center aperture 103. Setting the weight of plate 100 as 45 lbs or 35 lbs would allow interchangeability with other standard weight plates, thus leveraging the typical home gym user's familiarity with calculating the total weight on a bar, merely by counting the number of plates. With this arrangement, the user's likelihood of injury, due to miscalculating the total amount of weigh on a bar, can be reduced.

FIG. 1 additionally illustrates handles 105*a*-105*c*, located at the truncated corners of the triangular shape of plate 100. Handles 105*a*-105*c* ease the lifting of plate 100 onto and off from the weight shaft of a weight bar, and should be preferably sized and shaped to accommodate an adult hand comfortably. For example, handles 105*a*-105*c* could have rounded cross-sections in the portion that would rest within a user's hand. In many Olympic style free weights, an edge lip, such as a curved version of lips 102*a*-102*c*, provides a grip point for a user transporting the weight plate between a weight bar and a weight rack. However, a handle such as those illustrated, which enable a user's fingers to pass through the plate to grip a handle shaft, enable a more reliable grasp and reduce the likelihood of a user's sweat enabling plate 100 to slip and fall.

Fortunately, handles 105*a*-105*c* provide an additional benefit for the user's wallet: They enable plate 100 to be used in place of barbells for some exercises, such as shoulder shrugs. Use of plate 100 for barbell exercises, though, would likely be preferable for those exercises that do not require rotation of the barbell along the axis of the handle during the exercise, the way a curl exercise would.

Figure 4:
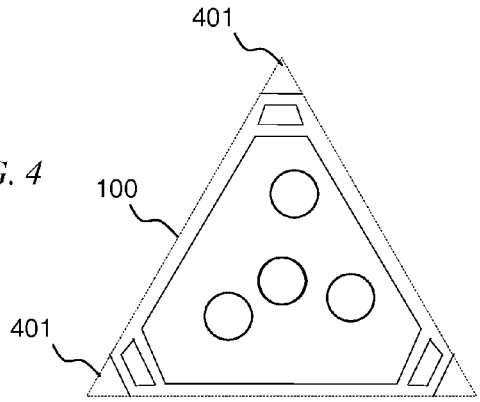
FIGS. 4 through 9 illustrate various geometric parameters associated with the embodiment of FIG. 1.
Figure 5:
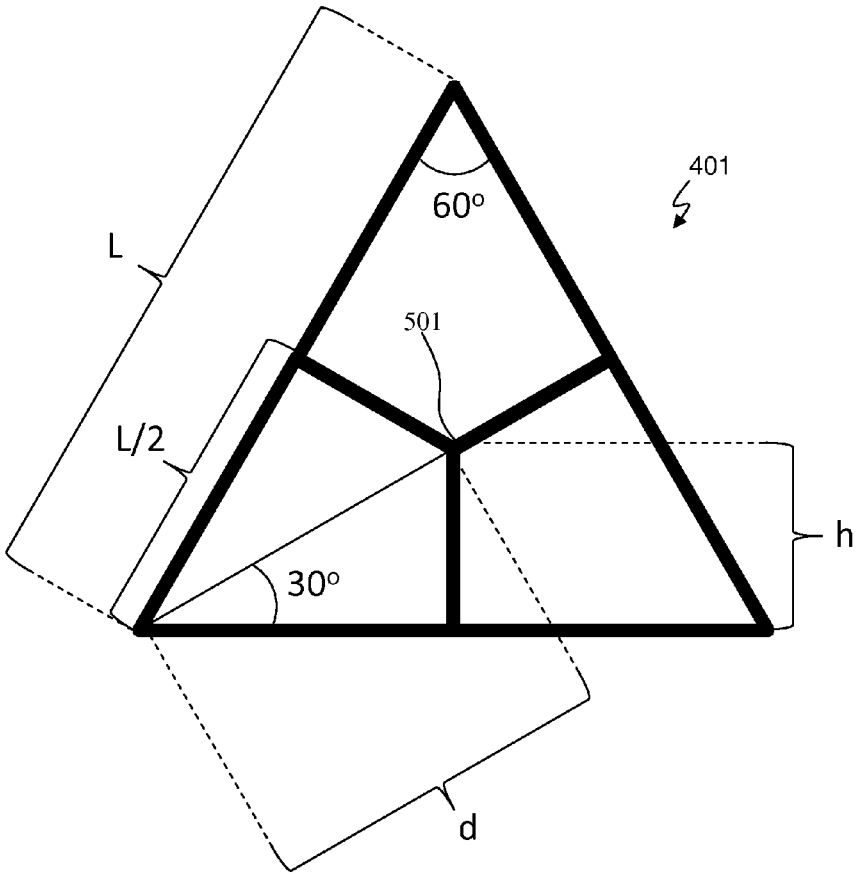

Turning now to FIG. 4, plate 100 is annotated with a notional equilateral triangle 401, which extends out at the corners, where plate was shortened for handles. Plate 100 may thus be described as being in the shape of an equilateral triangle, because the foreshortening for handles at each corner is a relatively minor deviation from an otherwise easily-recognized geometric shape. Some size and angle parameters for triangle 401 are indicated in FIG. 5. Setting triangle 401 to have a leg length, L, of approximately 18 inches will enable plate 100 to fit easily onto a common weight rack, among the standard sized 45-lb Olympic weight plates, without interfering with the storage of other weight plates on the rack. Standard-sized 45-lb Olympic weight plates range from around 42 to 45 centimeters (cm) in diameter, with the exact diameter measurement varying by manufacturer. If the length L of a leg of the equilateral triangle that is approximated by plate 100 (with differences at the position of the corner handles), is limited to 38 cm (which is 45 cm times cos(60 degrees)), there should be minimal interference on a weight rack caused by the triangular shape of plate 100 differing from the circular shape of traditional weight plates.

Further examination of FIG. 5 indicates that each angle of equilateral triangle 401 is 60 degrees, and a center point 501 of triangle 401 is located a distance d from each vertex (corner) and a distance h from the nearest point on each leg (flat edge). A line drawn from a vertex to center point 501 makes an angle of 30 degrees with respect to each leg. With this knowledge, the distances d and ha may be computed in terms of leg length L, wherein L provides a convenient size metric for triangle 401. Simple trigonometric expressions (with angle values in degrees), yield the following relationships:

$d*\cos(30)=L/2;$ $d=(L/2)*\sec(30);$ $d=(L/2)*(2/\mathrm{sqrt}(3));$ $d=L/\mathrm{sqrt}(3)$ $h=(L/\mathrm{sqrt}(3))*\sin(30);$ $h=(L/\mathrm{sqrt}(3))*(1/2);$ so that $h=L/(2*\mathrm{sqrt}(3)).$ The variable identifier h is used, for the distance from the edge, because this will be the height (h) of the central axis of a weight bar that is placed through an aperture centered at this central point. That is, if both ends of a weight bar 201, as illustrated in FIG. 2, are each placed through a center aperture located at center point 501 of plate 100, having triangle 401 sized with leg length L, and that assembly is set on a flat floor, then the center axis of bar 201 will be at a height h=L/(2*sqrt (3)) above the floor. For an L of 38 cm, h will be approximately 4.5 inches (4½ in). This is a comfortable height for many adult users to perform an assisted pushup.

Figure 6:
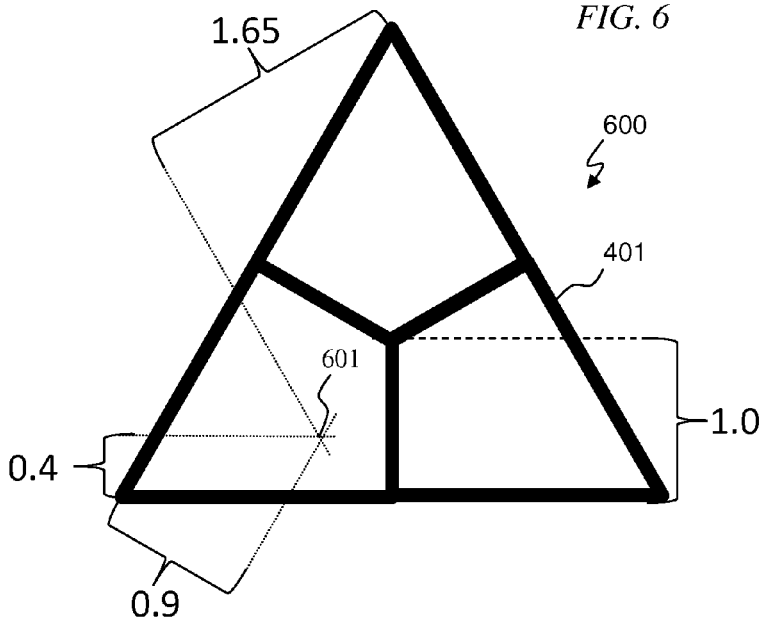

In FIG. 6, an offset point 601 is indicated within triangle 401, with triangle 401 in orientation 600. The distances in FIG. 6 are given relative to measurement h, and are thus normalized with h indicated as 1.0. It should be understood that FIG. 6, along with FIGS. 7-9 can be scaled to any value. In the normalized units of distance, offset point 601 is shown to be approximately 0.4 above the bottom edge, and at distances of approximately 0.9 and 1.65 from the other two edges. These distances are given in rounded values, for ease of illustration and explanation. Note that two of the distances are less than 1.0 and one is greater than 1.0. For an offset point, having at least two distances to edges different than 1.0 (in normalized h dimensions), at least one distance to an edge must be less than 1.0 (less than h), and at least one distance to an edge must be greater than 1.0 (greater than h).

Figure 7:
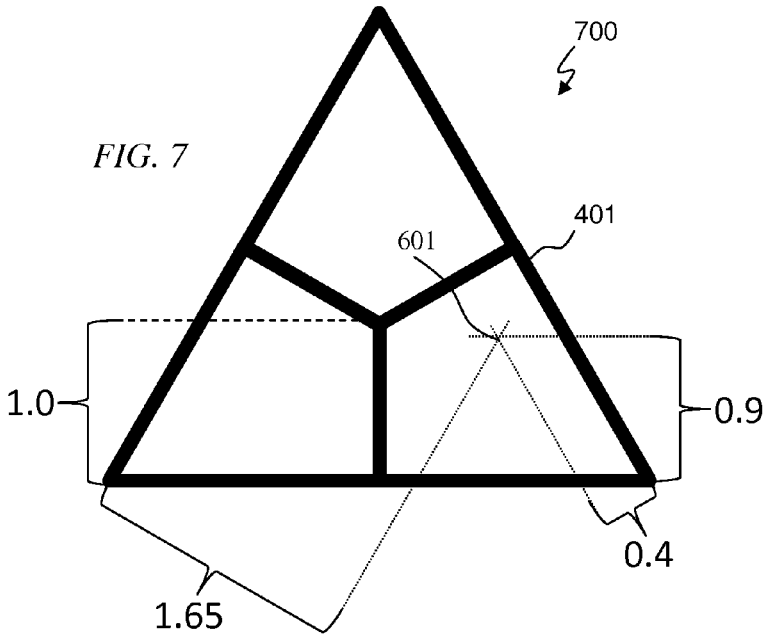
Figure 8:
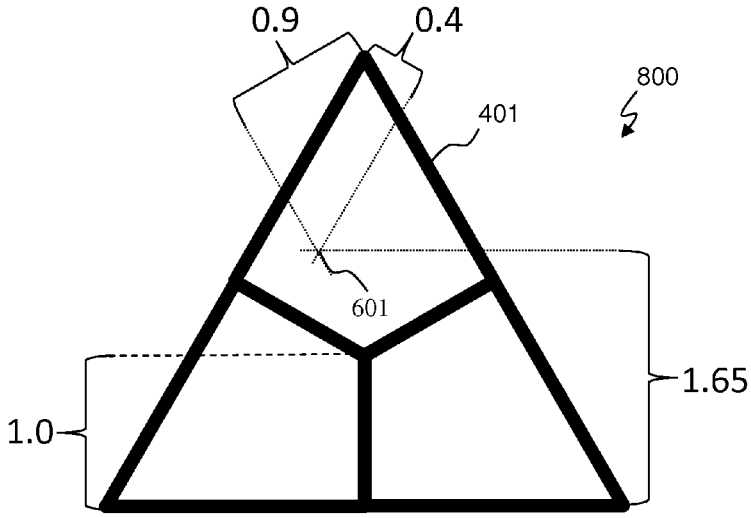

In FIGS. 7 and 8, the same triangle 401 with the same offset point 601 are illustrated, although with rotated orientations, which are indicated as orientation 700 and orientation 800. If two plates 100 were constructed to follow triangle 401, and each had an offset aperture centered at offset point 601, a weight bar placed through these offset apertures could be set parallel to the floor of a gym at three different heights: 0.4 h, 0.9 h, and 1.65 h. The specific height could be selected by a user, who desired to perform assisted pushups, merely by selecting one of orientation 600, orientation 700 and orientation 800. A height of 1.65 would be the most-assisted pushup, which would usually be the easiest to perform, whereas a height of 0.4 h would be the least-assisted pushup. This then is a variable-assist pushup system that requires only placing plates on the end of a weight bar, and selecting the desired orientation of the plates as the assembly is set on the floor.

Figure 9:
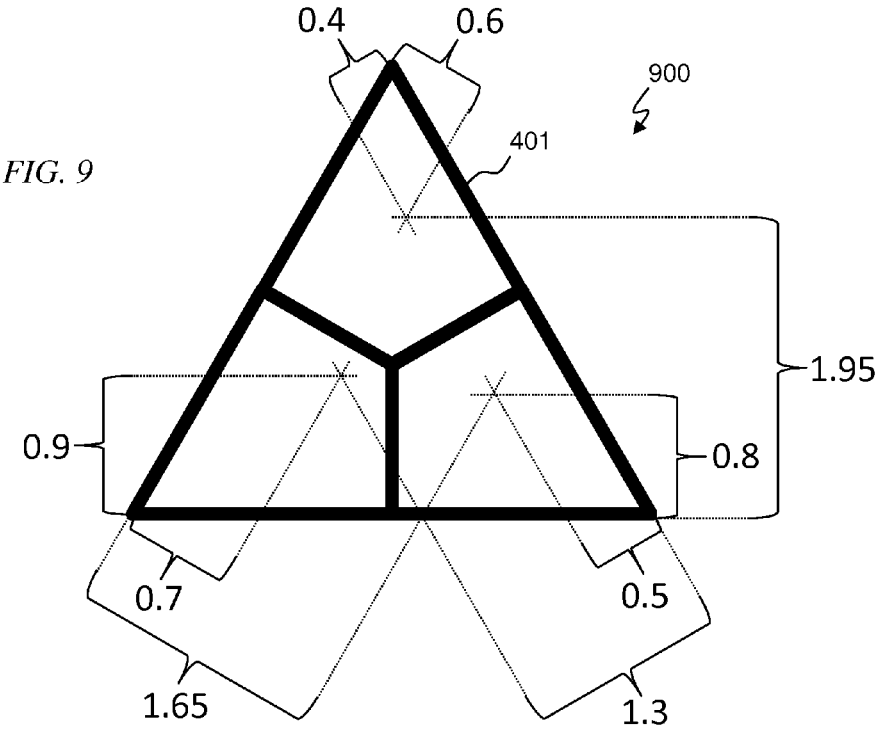

The exact position of an offset point, defining the center of an offset aperture, can be varied. The position indicated in FIGS. 6-8 is merely one possible position. Three alternative possible positions are indicated in FIG. 9. Producing a set of plates 100, which have offset apertures centered at each of these three positions, along with one centered at the triangle center point, provides a variable-assist pushup system with 10 different heights. These are approximated by rounded values: 0.4 h, 0.5 h, 0.6 h, 0.7 h, 0.8 h, 0.9 h, 1.3 h, 1.65 h, 1.95 h, and of course 1.0 h (when using the center aperture and any rotational orientation). In this manner, 10 different heights are achievable with a triangular shape, a center aperture, and three offset apertures.

There is an optional improvement for plate 100: it could be rendered rotationally balanced, to minimize rotational resistance when used as a weight plate in certain weightlifting exercises, such as curls. A reason that traditional weight plates are round is so that in whatever orientation they may start, there is minimal imbalance to cause them to rotate on a weight bar, when the weight bar is rotated during use. This is typically not an issue in bench press exercises, but during a curl exercise, the user actually rotates the weight bar as it is brought from the lowest to the highest position and then lowered back to the starting position. If the weight plates were not circular, and were otherwise rotationally balanced, then as the user lifted the bar, the weight plates would rotate opposite the weight bar's rotation, by constantly reorienting to point the heaviest portion downward. This could be a distraction for the user, at a time when the user wished to concentrate on muscle development, rather than equipment imbalance issues.

Rotational balance for circular weight plates is easy, because a circular disk is inherently rotationally balanced. The manufacturer needs only to focus on imbalances caused by raised lettering and ensuring that any shape reinforcement, such as radial ribs, have their weight equally distributed. For non-circular shapes having flat edges, the way to achieve rotational balance is to vary plate thickness as a function of angle, so that the plate has approximately equal weight distributed on both sides of any radial line passing through the center point.

Figure 10:
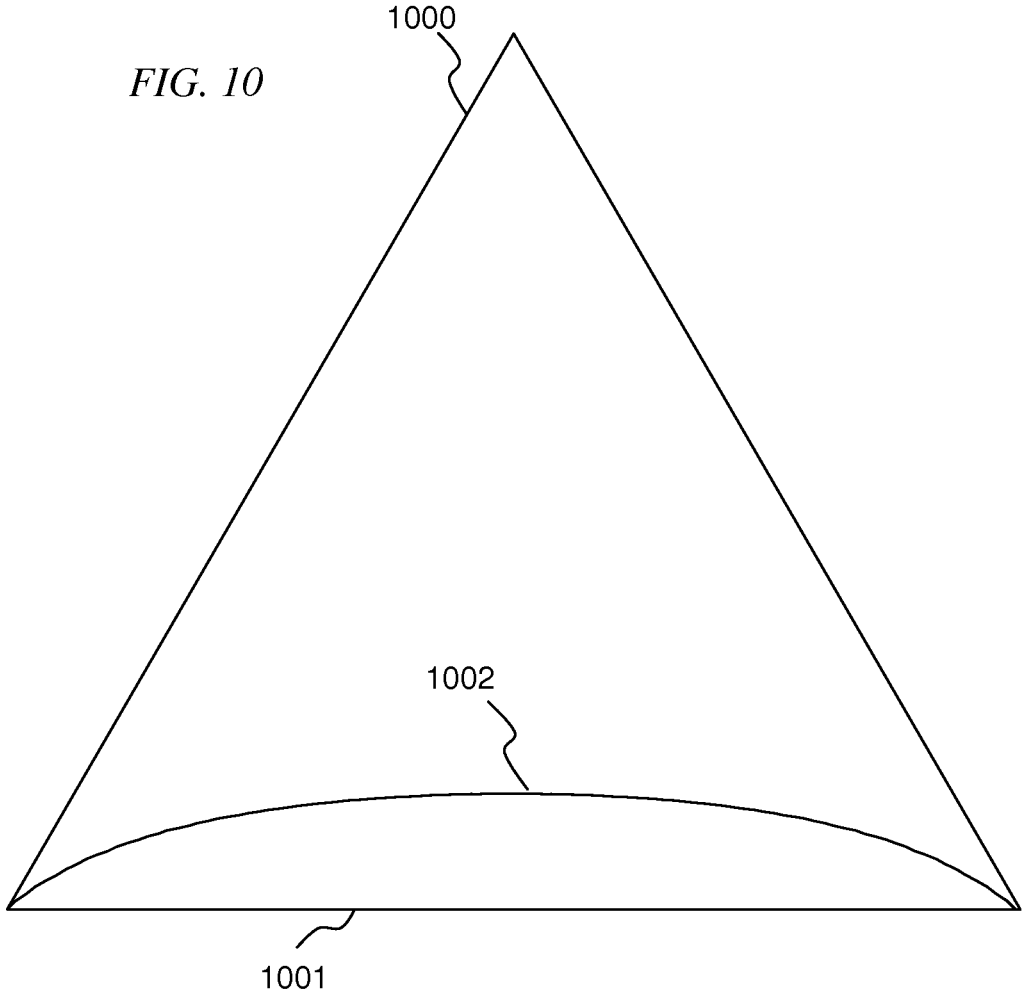
FIG. 10 illustrates curves for evenly distributing weight.

For offset apertures, a simple starting point is to ensure that any aperture collars contain approximately the same weight of material as is missing due to the void of the aperture. But the ideal situation is for the integral (from r=0 to r=R(θ)) of M(r, θ)*dr to be approximately constant for all θ from 0 to 360 degrees (2π radians), where r is the radial distance from the center point of the plate, θ is the angle measured from a reference 0-degree axis, R(θ) is the maximum radial extent of the plate for a given angle θ, and M(r, θ) is the mass of the plate at the (r, θ) coordinate. A bulge, which is a region of additional plate thickness, having an outline approximating a secant curve from −60 degrees to +60 degrees (for a bulge that doubled the nominal plate thickness), can help create rotational balance in a triangular shape. A triangle 1000 is illustrated in FIG. 10, having a straight edge 1001 and a bulge outline approximating an inverted, scaled secant curve 1002, plotted from −60 degrees to +60 degrees. The specifics of the bulge outline in a particular embodiment, however, will vary based on the placement of any offset apertures and the additional material thickness within the bulge region.

Referring again to FIG. 2, to use system 200 for situps, a user merely needs to select the apertures and plate orientation that provides a comfortable height at which the user can place toes or feet. The weight provided by each of plates **100*a* and 100*b* can hold weight bar 201 firmly in place for many users. For exceptionally heavy users, who might still cause system 200 to move around during a situp, the use of additional weight plates on bar 201, which are likely already in the possession of the user, can provide additional mass and stability. Typical Olympic style bench press bars weigh over 30 lbs, so if each of plates 100*a* and 100*b* weigh 45 lbs, system 200** will provide over 120 lbs of mass to hold the user's feet in place. No drilling to mount a bracket or use of a doorway is required.

There are some alternatives to system 200. Some embodiments of a complete system however, may use four plates 100, with two plates 100 on each of two shorter weight bars, such as the type dumb-bell bars onto which weight plates can be temporarily placed (as opposed to dumbbells with the weight plates permanently attached). Such a version will permit the user to grasp one of the weight bars in each hand and orient the wrists at different angles for more comfortable pushups. Another alternative to system 200 includes a bar with an end cap at each end, wherein each end cap has at least 3 flat edges, and each flat edge is a different radial distance from the bar.

Revisiting the advantages described earlier for an illustrated embodiment, the following comments should now be easily understood for the illustrated embodiments: (1) Provides for 10 different height adjustments for assisted pushups. The 10 different height adjustments were described with FIG. 9, and are selected by pacing weight bar 201 through a set of apertures 103 and 104*a*-104*c* and rotating each of the pair of plates 100 to a desired position. This count of 10 heights assumes that the user desires a level bar, on a level floor, and selects the corresponding apertures on both plates 100. More height possibilities are possible, if the user is willing to tolerate a sloped bar.

(2) Provides an adjustable ankle-holding situp bar to accommodate differently-sized feet. A user can use any of the 10 height arrangements to place whichever of their toes, feet, and ankles under the weight bar that is most comfortable for the user, when performing situps.

(3) Can compensate for an uneven surface. If the user must perform pushups in an exercise area with an uneven floor, different apertures or orientations can be selected for each of the pair of plates 100, to place the weight bar at different heights above the floor at each end. This can result in a fairly level weight bar 201, even if the floor is uneven. The number of available different heights may be impacted, though.

(4) Requires no permanent mounting. There is no need to permanently affix a plate 100 to a wall, because an embodiment may be sufficiently heavy enough to prevent undesired movement during exercises.

(5) Does not require use of a doorway. The disclosed system 200 can be used in any area having sufficient obstruction-free floor space. Due to the weight of some embodiments of system 200, no attachment, either permanent or temporary, is required in order to prevent undesired movement during use.

(6) Is highly compact for storage. The plates 100 can be removed from a weight bar for storage on a weight rack that many users already possess, and is separate from the weight bar. Because plate 100 can double as a weight plate for free weights, whether Olympic style, one-inch style, or another style, it can occupy the space within a gym that would otherwise be occupied by a weight plate. Thus, system 200 could potentially require no additional storage space at all!

(7) Can be disassembled for storage using a trivial procedure that is already well-known by most gym users. Weightlifters routinely remove collars from weight shafts for the purpose of removing weight plates, and place weight plates onto weight racks. Plate 100 can be removed and stored, using this common procedure.

(8) Leverages existing, widely-used and inexpensive home gym equipment to provide part of the system, in order to reduce costs to the user. Many home gyms already have weight bars and weight collars to hold free weights onto the weight bar's weight shafts.

(9) Can be used as a weight for some barbell exercises, such as shoulder shrugs. This stretches the user's money, because many embodiments of plate 100 can be manufactured from a single piece of cast metal, producing a form factor that is less complex than that of a barbell.

(10) Can be used as weight plates on a weight bar for weightlifting exercises, thereby further stretching the home gym user's money. Using center aperture 103, plate 100 can be used in a manner that is similar to a traditional weight plate. The user's cost for an entire version of some embodiments of system 200 becomes only double the price premium of plate 100 over a traditional weight plate of comparable weight.

All 10 of these features are available from plate 100, even when it is manufactured from only a single piece of cast metal that has no moving parts. Thus, any appearance of triviality in the form factor is a result of the elegance of the design in achieving all of these benefits simultaneously. The failure of others to furnish a product for the home gym market, which provides so many simultaneous advantages, is clear evidence of nonobviousness.

Although the present invention and its advantages have been described above, it should be understood that various changes, substitutions and alterations can be made herein without departing from the spirit and scope of the invention as defined by the appended claims. Moreover, the scope of the present application is not intended to be limited to the particular embodiments described in the specification.

What is claimed is:

1. An exercise apparatus consisting of:

a single, one-piece plate, the plate having:

a first straight edge;

a second straight edge oriented at an angle relative to the first straight edge;

a third straight edge oriented at the angle relative to the second straight edge, and located within the plane defined by the first straight edge and the second straight edge;

a circular center aperture disposed parallel to the plane, and centered at a center distance from each of the first straight edge, the second straight edge and the third straight edge; and a first offset aperture having a circular shape and a same diameter as the center aperture, centered at a first distance from the first straight edge, a second distance from the second straight edge, and a third distance from the third straight edge, wherein the first, second, third and center distances are all different and at least one of the first, second and third distances is greater than the center distance.

2. The apparatus of claim 1 wherein the plate has a material density of at least 6000 kilograms per cubic meter.

3. The apparatus of claim 1 wherein the plate further has:

a first handle between the first straight edge and the second straight edge;

a second handle between the second straight edge and the third straight edge; and a third handle adjacent to the third straight edge, opposite the second straight edge.

4. The apparatus of claim 1 wherein the angle is 60 degrees.

5. The apparatus of claim 1 wherein the angle is 90 degrees.

6. The apparatus of claim 1 wherein the plate is rotationally balanced about the center aperture.

7. The apparatus of claim 1 wherein the center aperture has a diameter between 50 and 54 millimeters.

8. The apparatus of claim 1 wherein the plate further has:

a second offset aperture having a circular shape and a same diameter as the center aperture, centered at a fourth distance from the first straight edge, a fifth distance from the second straight edge, and a sixth distance from the third straight edge, wherein the fourth, fifth, sixth and center distances are all different and at least one of the fourth, fifth and sixth distances is greater than the center distance.

9. The apparatus of claim 8 wherein each of the fourth, fifth and sixth distances is different from all of the first, second and third distances.

10. The apparatus of claim 8 wherein the plate further has:

a third offset aperture having a circular shape and a same diameter as the center aperture, centered at a seventh distance from the first straight edge, an eighth distance from the second straight edge, and a ninth distance from the third straight edge, wherein the seventh, eighth, ninth and center distances are all different and at least one of the seventh, eighth and ninth distances is greater than the center distance.

11. The apparatus of claim 10 wherein each of the seventh, eighth and ninth distances is different from all of the first, second, third, fourth, fifth and sixth distances.

12. The apparatus of claim 1 wherein the plate weighs between 40 and 50 pounds.

13. An exercise apparatus consisting of:

a single, one-piece plate with no permanent attachments, having a material density of at least 6000 kilograms per cubic meter, the plate having:

a first straight edge;

a second straight edge oriented at an angle of 60 degrees relative to the first straight edge;

a third straight edge oriented at an angle of 60 degrees relative to the second straight edge and oriented at an angle of 60 degrees relative to the first straight edge, and located within the plane defined by the first straight edge and the second straight edge;

a circular center aperture disposed parallel to the plane with a diameter between 50 and 54 millimeters, centered at a center distance from each of the first straight edge, the second straight edge and the third straight edge; and a first offset aperture having a circular shape and a same diameter as the center aperture, centered at a first distance from the first straight edge, a second distance from the second straight edge, and a third distance from the third straight edge, wherein at least one of the first, second and third distances is greater than the center distance;

a second offset aperture having a circular shape and a same diameter as the center aperture, centered at a fourth distance from the first straight edge, a fifth distance from the second straight edge, and a sixth distance from the third straight edge, wherein at least one of the fourth, fifth and sixth distances is greater than the center distance;

a third offset aperture having a circular shape and a same diameter as the center aperture, centered at a seventh distance from the first straight edge, an eighth distance from the second straight edge, and a ninth distance from the third straight edge, wherein at least one of the seventh, eighth and ninth distances is greater than the center distance, and all of the first, second, third, fourth, fifth, sixth, seventh, eighth, ninth and center distances are different;

a first handle between the first straight edge and the second straight edge;

a second handle between the second straight edge and the third straight edge; and a third handle between the first straight edge and the third straight edge.

14. An exercise apparatus comprising:

a first plate having:

a first straight edge;

a second straight edge oriented at an angle relative to the first straight edge;

a third straight edge oriented at the angle relative to the second straight edge, and located within the plane defined by the first straight edge and the second straight edge;

a circular center aperture disposed parallel to the plane, and centered at a center distance from each of the first straight edge, the second straight edge and the third straight edge;

a first offset aperture having a circular shape and a same diameter as the center aperture, centered at a first distance from the first straight edge, a second distance from the second straight edge, and a third distance from the third straight edge, wherein the first, second, third and center distances are all different and at least one of the first, second and third distances is greater than the center distance;

a bar configured to pass through either of the center aperture and the first offset aperture, such that the bar extends perpendicular to the plane; and a second plate identical to the first plate.

15. The apparatus of claim 14 wherein the first plate weighs between 40 and 50 pounds.

* * * * *